US007883676B2

(12) United States Patent
Hazlebeck et al.

(10) Patent No.: US 7,883,676 B2
(45) Date of Patent: Feb. 8, 2011

(54) HYDROLYSIS SYSTEM AND PROCESS FOR DEVICES CONTAINING ENERGETIC MATERIAL

(75) Inventors: David A. Hazlebeck, El Cajon, CA (US); David W. Ordway, Poway, CA (US); Louie Wong, San Diego, CA (US)

(73) Assignee: General Atomics, San Diego, CA (US)

( * ) Notice: Subject to any disclaimer, the term of this patent is extended or adjusted under 35 U.S.C. 154(b) by 747 days.

(21) Appl. No.: 11/535,877

(22) Filed: Sep. 27, 2006

(65) Prior Publication Data

US 2008/0086024 A1 Apr. 10, 2008

(51) Int. Cl.
*B01J 7/02* (2006.01)

(52) U.S. Cl. ..... 422/237; 422/238; 422/239; 422/271; 422/301

(58) Field of Classification Search ..... 422/237–239, 422/271, 301

See application file for complete search history.

(56) References Cited

U.S. PATENT DOCUMENTS

| | | | | |
|---|---|---|---|---|
| 4,327,027 | A | | 4/1982 | Howard et al. |
| 4,351,978 | A | | 9/1982 | Hatano et al. |
| 4,366,846 | A | | 1/1983 | Curati, Jr. |
| 4,447,541 | A | | 5/1984 | Peterson |
| 4,624,604 | A | | 11/1986 | Wagner et al. |
| 4,752,402 | A | | 6/1988 | Gray |
| 5,096,600 | A | | 3/1992 | Hoch |
| 5,258,303 | A | | 11/1993 | Stenger |
| 5,516,971 | A | | 5/1996 | Hurley |
| 5,622,864 | A | | 4/1997 | Buchanan |
| 5,737,709 | A | | 4/1998 | Getty et al. |
| 5,804,434 | A | | 9/1998 | Cash |
| 6,017,499 | A | * | 1/2000 | Albert ..... 422/239 |
| 6,127,591 | A | | 10/2000 | Shah |
| 6,245,958 | B1 | | 6/2001 | Morse et al. |

* cited by examiner

*Primary Examiner*—Stanley Silverman
*Assistant Examiner*—James A Fiorito
(74) *Attorney, Agent, or Firm*—Nydegger & Associates

(57) ABSTRACT

A system for chemically disposing energetic material enclosed in assembled devices includes a porous basket. The porous basket forms an enclosed chamber for receiving the assembled devices. Further, the basket is supported by a rotatable basket arm that is, in turn, connected to a lifting arm. In addition to these structures, the system includes a tank that holds a hydrolysis solution. The tank is positioned to allow the lifting arm to submerge the basket into the solution. After submersion, the basket arm rotates the basket in the solution to flow the hydrolysis solution into contact with the assembled devices therein. As a result, the assembled devices react with the solution so that the solution penetrates the assembled devices, allowing the solution to contact and react with the energetic material to render the energetic material non-energetic.

11 Claims, 2 Drawing Sheets

HYDROLYSIS SYSTEM AND PROCESS FOR DEVICES CONTAINING ENERGETIC MATERIAL

The U.S. Government has a paid-up license in this invention and the right in limited circumstances to require the patent owner to license others on reasonable terms as provided for by the terms of Contract No. F08630-02-C-0083 awarded by the United States Air Force.

FIELD OF THE INVENTION

The present invention pertains generally to the destruction of munitions or other devices containing enclosed energetic materials. In particular, the present invention pertains to the destruction of such materials via hydrolysis. The present invention is particularly, but not exclusively, useful as a system and method for chemically disposing energetic materials enclosed in assembled devices without pretreatment of the assembled devices.

BACKGROUND OF THE INVENTION

Destruction of devices containing energetic materials such as explosives, munitions and propellants is a hazardous operation. Often, energetic materials are mechanically removed from these devices. For instance, such materials may be removed by "autoclave melting out" or "steaming out." However, these processes cannot be used for energetic materials having high melting points, or those energetic materials which ignite before they melt. Another mechanical process used to remove energetic materials is fluid washout by cavitating or non-cavitating high pressure jets. The cavitating jet process involves the impact of vapor bubbles on the devices and may create uncontrolled reactions in the energetic material. Further, non-cavitating fluid jets typically do not operate at pressures that are adequate for efficient erosion of the energetic material. In addition, both of the jet processes use extensive amounts of water, which may be undesirable in certain environments. In other instances, the energetic material may be disposed of by open burning, open detonation, or incineration. However, such methods are not preferred due to the resulting pollution.

While these and other methods are generally effective, they do not obviate the danger involved in mechanically operating on devices encapsulating energetic material. In light of the above, it is an object of the present invention to provide a system and method for chemically disposing energetic material enclosed in assembled devices. Another object of the present invention is to provide a system and method for disposing energetic material enclosed in assembled devices with minimal pretreatment of the devices and without detonating or igniting the energetic material. Another object of the present invention is to provide a system and method for disposing energetic material enclosed in assembled devices without mechanically operating on the devices. Another object of the present invention is to provide a system and method for disposing of energetic materials enclosed in assembled devices in which the assembled devices are chemically penetrated to allow access to the energetic material. Still another object of the present invention is to provide a system and method for disposing of energetic materials in assembled devices in which the energetic material is exposed only within a hydrolysis solution. Yet another object of the present invention is to provide a system for disposing energetic material enclosed in assembled devices which is simple to operate, relatively easy to manufacture, and comparatively cost effective.

SUMMARY OF THE INVENTION

In accordance with the present invention, a system for chemically disposing energetic material enclosed in assembled devices comprises a porous basket for receiving the devices. For the present invention, the basket is connected to a basket arm for rotation about a basket axis. Further, the basket is connected to a lifting arm for moving the basket into and out of a tank holding a caustic or acidic hydrolysis solution. For the present invention, the basket is submerged in the hydrolysis solution by the lifting arm and is rotated therein by the basket arm. Preferably, a caustic hydrolysis solution is between approximately 60° C. and approximately 130° C. and between about 4 wt. % and about 50 wt. % sodium hydroxide. Further, an acidic hydrolysis solution is preferably between approximately 50° C. and approximately 80° C. and between about 3M and about 8M nitric acid.

Upon submersion of the devices in the hydrolysis solution, the solution flows into contact with the assembled devices to facilitate a reaction. During the reaction between the assembled devices and the hydrolysis solution, the assembled devices are penetrated by the hydrolysis solution. As a result, the hydrolysis solution contacts and reacts with the energetic material to render the energetic material non-energetic.

For the present invention, the system further includes a rinse fluid housed in a container. In order to use the rinse fluid, the lifting arm is adapted to remove the basket from the hydrolysis solution after the energetic material is rendered non-energetic, and to immerse the basket in the rinse fluid. Similar to its use with the hydrolysis solution, the basket arm is adapted to revolve the basket in the rinse fluid to rinse off components remaining in the basket.

As an additional component, the system includes a heat exchanger for selectively adding and removing heat from the hydrolysis solution. By modulating the temperature of the solution with the heat exchanger, the reaction rate can be controlled. Alternatively, or additionally, the solution temperature and reaction rate may be controlled by selectively adjusting the surface area of the solution. Specifically, the system includes surface objects, such as floats, that may be positioned on or removed from the surface of the solution. As a result, the exposed surface area of the solution is selectively increased or decreased. In this manner, the evaporation rate and temperature of the solution are controlled.

For purposes of the present invention, the system also includes an exhaust hood for capturing hydrogen or other gases that are released during the hydrolysis process. In order to prevent a build up of the gases to explosive levels, the system is provided with a diluting device that mixes air into the gases to dilute them to non-explosive concentrations. Further, the exhaust hood is provided with an exhaust vent to eliminate gases from the hood.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
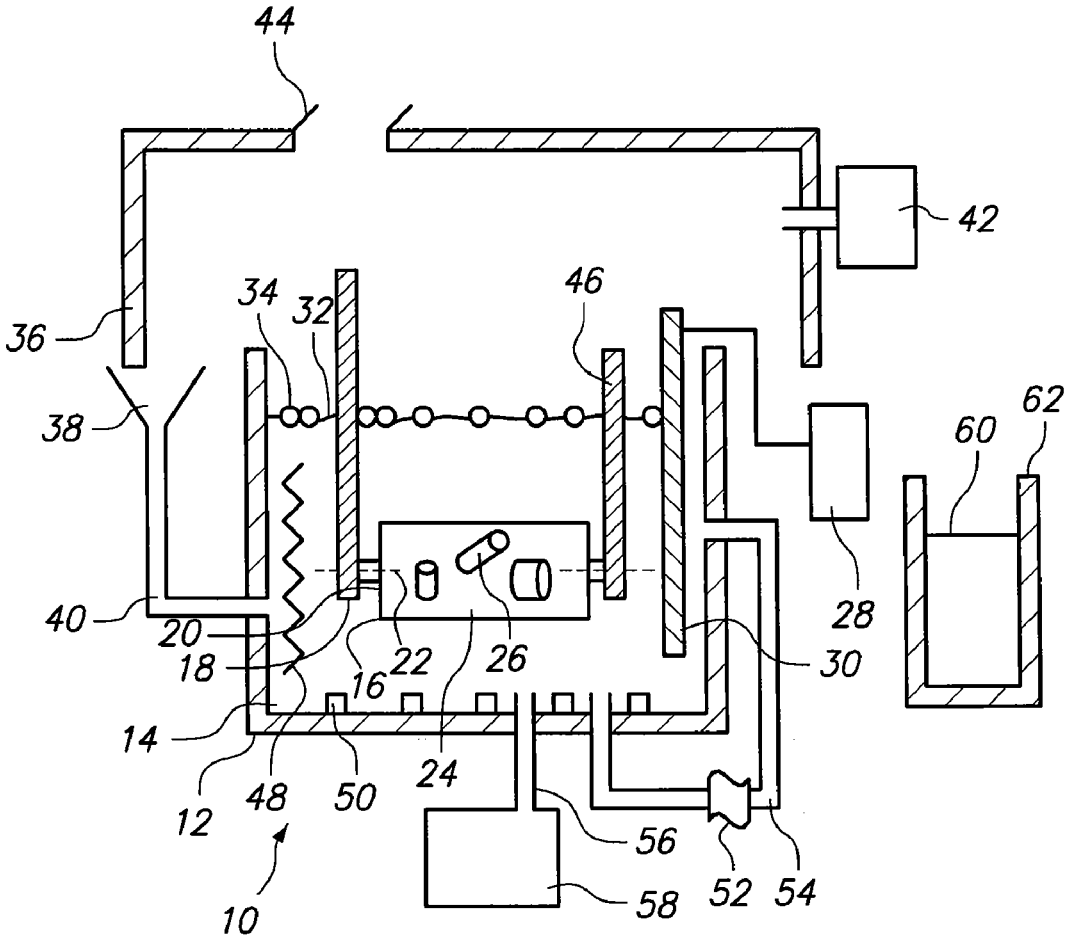
FIG. 1 is a schematic view of the system for disposing energetic material enclosed in assembled devices in accordance with the present invention.

Referring initially to FIG. 1, a system for chemically disposing energetic material enclosed in devices such as munitions and propellants in accordance with the present invention is shown and generally designated 10. As shown, the system 10 includes a tank 12 holding a hydrolysis solution 14. As shown in FIG. 1, the system 10 further includes a perforated or porous basket 16 that may be completely submerged within the solution 14. Specifically, the basket 16 is mounted on a lifting arm 18 that is adapted to transport the basket 16 into and out of the solution 14. Further, the basket 16 is connected to a basket arm 20 that is provided to rotate the basket 16 about a basket axis 22. For the purposes of the present invention, the porous basket 16 forms an enclosed chamber 24 for receiving and holding munitions, cartridge-activated devices, or other assembled devices 26 that enclose energetic material 27 (shown in FIG. 2) including propellants, explosives, smokes or dyes. The porosity of the basket 16 allows the solution 14 to enter the basket 16 and contact the devices 26 while holding the devices 26 within the chamber 24. Upon contact, the devices 26 react with the solution 14 within the basket 16 and eventually penetrate the devices 26 to react with, the energetic material 27.

For the purposes of the present invention, it is important to keep the basket 16 completely submerged to maintain the continual moderating effect of the solution 14. If a portion of the basket 16 emerges from the solution 14 during the reaction of the devices 26, then energetic material 27 can adhere to the wall of the tank 12 or otherwise be pulled out of the solution 14. Without the moderating effect of the solution 14, the heat of the hydrolysis reaction can ignite or detonate the unreacted energetic material 27.

For a caustic hydrolysis solution 14, the solution 14 preferably contains between approximately 4-50 wt. % sodium hydroxide. Preferably, a solution 14 containing sodium hydroxide is kept between approximately 60-130° C. For an acidic hydrolysis solution 14, the solution 14 preferably contains between about 3M and about 5M nitric acid and is kept between approximately 50-80° C. While sodium hydroxide and nitric acid are expressly disclosed herein, other bases or acids could be used.

In order to keep the solution 14 at a desired temperature, the system 10 is provided with a controller 28 and a heat exchanger 30. Specifically, the controller 28 is able to monitor the temperature of the solution 14 and to operate the heat exchanger 30 to increase or decrease the temperature as needed. Additionally or alternatively, the temperature of the solution 14 may be controlled by manipulating the exposed surface area of the solution 14. As shown in FIG. 1, the solution 14 has an exposed surface 32 which has an area. Because evaporation of the solution 14 can only occur at the surface 32, controlling the amount of surface area available for evaporation allows for control of the temperature of the solution 14. With this in mind, the system 10 is provided with surface objects 34, such as floats, that serve to reduce the surface area available for evaporation. As with the heat exchanger 30, the placement of the surface objects 34 on the surface 32 of the solution 14 may be controlled by the controller 28.

When the solution 14 evaporates from the surface 32 it is captured by an exhaust hood 36 that is positioned over the tank 12. In order to recycle the solution 14 that evaporates from the surface 32, the system 10 is provided with a condensation device 38 that condenses the solution 14 in vapor form, and returns the condensed solution 14 back to the tank 12 via a condensation return 40. For the present invention, the exhaust hood 36 also captures hydrogen and/or other gases released as a result of reactions within the solution 14. In order to prevent a build up of these gases to explosive levels, the system 10 is provided with a diluting device 42 that mixes air into the gases to dilute them to non-explosive concentrations. Also, condensable components of the gases, such as water, may be condensed and returned to the solution 14 via the condensation return 40. Further, the exhaust hood 36 is provided with an exhaust vent 44 to provide for the elimination of gases.

As stated above, the basket arm 20 is provided to rotate the basket 16 in the solution 14. Operationally, the basket 16 and basket arm 20 are rotated by a rotation mechanism 46. If the basket 16 were not rotated, gas produced during reactions in the solution 14 would form in pockets around the devices 26. As a result, the pockets would prevent the solution 14 from contacting all of the material to be hydrolyzed and could potentially lead to explosive gas mixtures within the solution 14. Further, without basket rotation, the reactants in the solution 14 may be depleted locally around material to be hydrolyzed. However, rotation of the basket ensures that no local depletion in the solution 14 occurs. For the present invention, the basket 16 is rotated until all of the energetic material 27 is rendered non-energetic.

As further shown in FIG. 1, the system 10 provides for mixing the solution 14. Specifically, a mechanical agitator 48, jets 50, and/or a recirculation pump 52 in fluid communication with the solution 14 via recirculation line 54 are provided to mix the solution 14. As is also shown, the system 10 includes an effluent removal line 56 for the removal of used caustic or non-gaseous products of the reactions within the solution 14. In order to neutralize the effluent, the removal line 56 delivers the effluent to a treatment device 58 where the effluent may be oxidized, neutralized, or otherwise modified to a less hazardous form. Alternatively, the solution 14 may be reused for subsequent batches of devices 26. Importantly, the porosity of the basket 16 allows for reuse of the solution 14, if desired, since it keeps solid contaminants within the basket 16 while the solution 14 drains out of the basket 16.

For the present invention, the system 10 further provides for post-reaction treatment of the components remaining in the basket 16, i.e., the materials not reactive to the solution 14. Specifically, the system 10 includes a rinse fluid 60 that is held within a container 62. Further, the lifting arm 18 is adapted to remove the basket 16 from the tank 12 and to immerse the basket 16 in the rinse fluid 60. As during the reaction process, the basket arm 20 is able to rotate or revolve the basket 16 within the rinse fluid 60 to rinse off the non-reactive components remaining in the basket 16. After the components are thoroughly rinsed, the basket 16 is withdrawn from the rinse fluid 60 and is unloaded.

Figure 2:
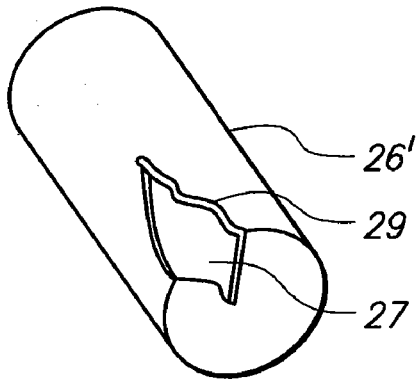
FIG. 2 is a perspective view of a partially corroded assembled device in accordance with the present invention.

As shown in FIG. 1, the assembled devices 26 initially enclose the energetic material 27 (shown in FIG. 2) so that it is not exposed to the solution 14 when the basket 16 is submerged. By avoiding the requirement that the devices 26 be preprocessed to provide access to the energetic material 27, the likelihood of accidental initiation of the energetic material 27 is significantly decreased. With that in mind, for the present invention, the devices 26 are positioned in the basket 16 and introduced to the solution 14 while still completely enclosing the energetic material 27. Typically, the devices 26 are formed from aluminum or other materials that are attacked by the solution 14. During the reaction between the solution 14 and the devices 26, the solution 14 corrodes the devices 26. Eventually, the solution 14 penetrates the devices 26 and contacts and reacts with the energetic material 27. As shown in FIG. 2, the solution 14 has partially corroded device 26' and contacted the energetic material 27. Specifically, the wall 29 of the device 26' has been breached and energetic material 27 is exposed. For devices 26 made from materials that are impervious to the solution 14, such as stainless steel, then a path of entry for the solution 14 must be made prior to use of the system 10.

Figure 3:
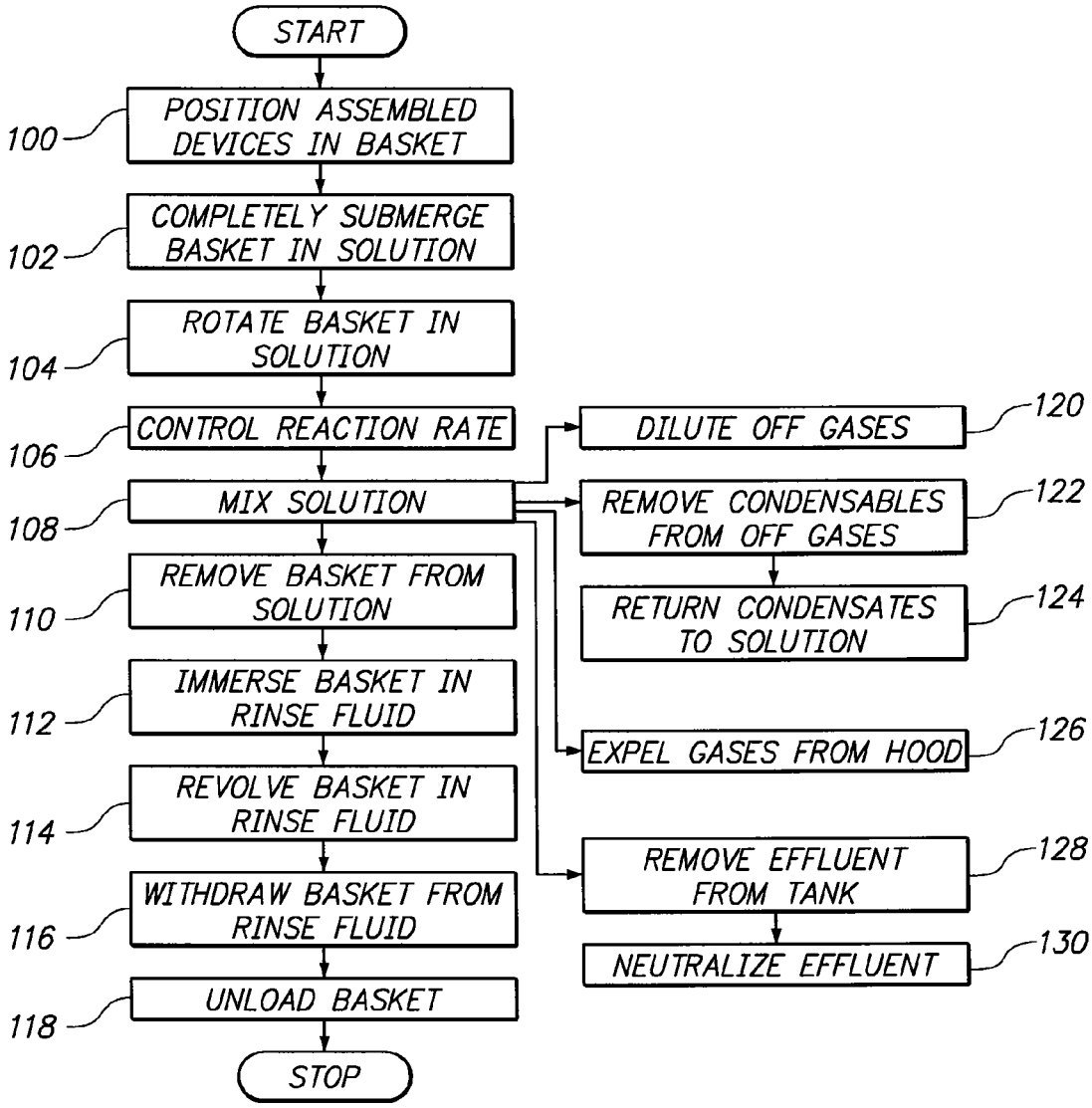
FIG. 3 is an operational flow chart of the method for disposing of energetic material enclosed in assembled devices in accordance with the present invention.

Referring now to FIG. 3, the operation of the system 10 of the present invention is illustrated. As shown in FIG. 3, the method commences with the step of positioning the assembled devices in the porous basket (action block 100). As discussed above, the assembled devices need not be pretreated or preprocessed to expose the energetic material within the devices. After the devices are received in the porous basket, the basket is closed and is completely submerged in the caustic solution held in the tank (action block 102).

Complete submersion of the basket ensures that the solution maintains its moderating effect on the energetic material. If the basket or tank emerges from the solution before the energetic material is rendered non-energetic, the heat of hydrolysis can ignite or detonate the energetic material. Further, if the energetic material emerges from the solution, it may adhere to the tank or another device component. After it is submerged, the basket is rotated in the solution to facilitate a reaction between the assembled devices and the caustic hydrolysis solution. For the present invention, rotation of the basket prevents the formation of pockets of gas on the devices and ensures that all surfaces of the devices are contacted with the caustic solution (action block 104).

While the basket is submerged and rotated, the reaction rate between the device, energetic material and caustic solution is controlled (action block 106). Specifically, the reaction rate may be controlled by manipulating the temperature of the solution by selectively adding heat thereto or removing heat therefrom. Alternatively or additionally, the reaction rate may be controlled by selectively increasing and decreasing the surface area of the caustic hydrolysis solution to control the temperature of the solution. For either method, the caustic hydrolysis solution is preferably kept between approximately 60° C. and approximately 130° C.

As shown in action block 108, the method further includes the step of mixing the solution. In practice, the solution may be mixed by a mechanical agitator in the tank, by forcing fluid into the tank via jets, or by recirculating the solution through the tank.

When the energetic material has fully reacted and is rendered non-energetic, the basket is removed from the solution (action block 110) by the lifting arm. The lifting arm then immerses the basket in the rinse fluid (action block 112). While in the rinse fluid, the basket is revolved in order to rinse off any components remaining in the basket (action block 114). Thereafter, the basket is withdrawn from the rinse fluid (action block 116) and any remaining components are unloaded from the basket (action block 118). The remaining components, such as unreacted non-energetic remnants of the devices may be recovered and recycled.

As further shown in FIG. 3, the method may also include the step of diluting the hydrogen in the off gases with air to ensure that the hydrogen level is below the explosive limit (action block 120). Further, the condensable components of the off gases may be removed from the off gases by condensation (action block 122). Thereafter, the condensates, such as water, may be returned to the hydrolysis solution in the tank (action block 124). Further, the method may include the step of expelling gases from the hood (action block 126). Specifically, gases may be expelled through the vent in the hood in order to maintain desired conditions in the hood. Likewise, effluent may be removed from the tank (action block 128) and neutralized (action block 130) for further uses or safe disposal. As a result of the system's control over the solution, gases, condensate, and effluent, the tank of solution may be reused, repeating the above steps with another batch of assembled devices.

While the particular Hydrolysis System and Process for Devices Containing Energetic Material as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A system for chemically disposing energetic material enclosed in assembled devices comprising:

a hydrolysis solution;

a tank for holding the hydrolysis solution;

a basket for holding the assembled devices wherein each device includes a wall for enclosing the energetic material;

a lifting arm for completely submerging the basket in the hydrolysis solution, with the hydrolysis solution flowing into contact with the assembled devices;

a heat exchanger partially submerged in the hydrolysis solution to modulate and control the temperature of the hydrolysis solution;

a plurality of surface objects, wherein the hydrolysis solution has a surface area, and the surface objects are selectively positioned on the surface area of the hydrolysis solution to control the evaporation rate of the hydrolysis solution; and a basket arm for rotating the basket in the hydrolysis solution to facilitate a reaction between the assembled devices and the hydrolysis solution, with said reaction leading to a chemical penetration through the wall of each of the assembled devices by the hydrolysis solution during submersion of the devices in the hydrolysis solution, and to allow the hydrolysis solution to contact and react with the energetic material during submersion of the device to render the energetic material non-energetic.

2. A system as recited in claim 1 further comprising:

means for removing the holding means from the hydrolysis solution after the energetic material is rendered non-energetic;

means for immersing the holding means in a rinse fluid; and means for revolving the holding means in the rinse fluid to rinse off components remaining in the holding means.

3. A system as recited in claim 2 further comprising:

means for withdrawing the holding means from the rinse fluid; and means for unloading remaining components from the holding means.

4. A system as recited in claim 1 wherein the reactions between the assembled devices, the energetic material, and the hydrolysis solution occur at a reaction rate, with the system further comprising means for controlling the reaction rate, said controlling means including means for selectively adding heat to the hydrolysis solution and means for selectively removing heat from the hydrolysis solution.

5. A system as recited in claim 1 wherein the reactions between the assembled devices, the energetic material, and the hydrolysis solution occur at a reaction rate, and wherein the hydrolysis solution has a surface area, with the system further comprising means for controlling the reaction rate, said controlling means including means for selectively increasing and decreasing the surface area of the hydrolysis solution.

6. A system as recited in claim 1 wherein the hydrolysis solution is between approximately 60° C. and approximately 130° C. and between about 4 wt.% and 50 wt.% sodium hydroxide.

7. A system as recited in claim 1 wherein the hydrolysis solution is between approximately 50° C. and approximately 80° C. and between about 3M and 8M nitric acid.

8. A system for chemically disposing energetic material enclosed in assembled devices comprising:

a porous basket including an enclosed chamber for receiving the assembled devices wherein each device includes a wall for enclosing the energetic material;

a basket arm connected to said basket to rotate said basket about a basket axis;

a lifting arm connected to the basket arm;

a heat exchanger partially submerged in the hydrolysis solution to modulate and control the temperature of the hydrolysis solution;

a plurality of surface objects, wherein the hydrolysis solution has a surface area, and the surface objects are selectively positioned on the surface area of the hydrolysis solution to control the evaporation rate of the hydrolysis solution; and a tank holding a hydrolysis solution, with said tank positioned to allow said lifting arm to completely submerge said basket into the hydrolysis solution, and to allow said basket arm to rotate said basket in the hydrolysis solution to flow the hydrolysis solution into contact with the assembled devices therein to facilitate a reaction between the assembled devices and the hydrolysis solution, wherein said reaction leads to a chemical penetration of the wall of each of the assembled devices by the hydrolysis solution during submersion of the devices in the hydrolysis solution, with said penetration allowing the hydrolysis solution to contact and react with the energetic material during submersion of the device to render the energetic material non-energetic.

9. A system as recited in claim 8 further comprising a rinse fluid housed in a container, and wherein the lifting arm is adapted to remove the basket from the hydrolysis solution after the energetic material is rendered non-energetic and to immerse the basket in the rinse fluid, and wherein the basket arm is adapted to revolve the basket in the rinse fluid to rinse off components remaining in the basket.

10. A system as recited in claim 8 wherein the hydrolysis solution is between approximately 60° C. and approximately 130° C. and between about 4 wt.% and 50 wt.% sodium hydroxide.

11. A system as recited in claim 8 wherein the hydrolysis solution is between approximately 50° C. and approximately 80° C. and between about 3M and 8M nitric acid.

* * * * *